US006578811B1

(12) United States Patent
Suzuki

(10) Patent No.: US 6,578,811 B1
(45) Date of Patent: Jun. 17, 2003

(54) PAPER HOLDER

(75) Inventor: Hitoshi Suzuki, Tokyo (JP)

(73) Assignee: Hiromori Inc., Tokyo (JP)

( * ) Notice: Subject to any disclaimer, the term of this patent is extended or adjusted under 35 U.S.C. 154(b) by 0 days.

(21) Appl. No.: 10/039,013

(22) Filed: Jan. 2, 2002

(51) Int. Cl.[7] ..... A47G 1/16

(52) U.S. Cl. ..... 248/451; 248/447; 248/473; 248/469

(58) Field of Search ..... 248/451, 447, 248/473, 469; 40/650, 651, 652

(56) References Cited

U.S. PATENT DOCUMENTS

| | | | | |
|---|---|---|---|---|
| 511,366 | A | | 12/1893 | Sinz |
| 2,006,887 | A | | 7/1935 | Doherty |
| 2,540,546 | A | | 2/1951 | Putz |
| 3,398,475 | A | | 8/1968 | Palmer |
| 4,097,971 | A | | 7/1978 | Morris |
| 4,261,121 | A | | 4/1981 | Coon |
| 4,525,899 | A | | 7/1985 | Carroll |
| D333,154 | S | | 2/1993 | Hiromori |
| 5,335,399 | A | | 8/1994 | Chou |
| 5,479,682 | A | | 1/1996 | Hendrikx et al. |
| 5,621,950 | A | | 4/1997 | White |
| 5,667,183 | A | | 9/1997 | Hiromori |
| 5,697,594 | A | | 12/1997 | Adams et al. |
| D401,968 | S | * | 12/1998 | Suzuki ..... D19/65 |
| 5,845,889 | A | | 12/1998 | Suzuki |
| D419,602 | S | | 1/2000 | Mori |
| D448,418 | S | * | 9/2001 | Langenbach ..... D19/90 |
| D452,709 | S | * | 1/2002 | Najmi ..... D19/86 |
| 6,367,761 | B1 | | 4/2002 | Suzuki |
| 6,481,687 | B2 | * | 11/2002 | Najmi ..... 248/452 |
| D466,556 | S | * | 12/2002 | Rosado ..... D19/90 |
| D468,359 | S | * | 1/2003 | Chen ..... D19/65 |

FOREIGN PATENT DOCUMENTS

| | | |
|---|---|---|
| JP | 63/23169 | 6/1988 |

* cited by examiner

*Primary Examiner*—Leslie A. Braun
*Assistant Examiner*—Ingrid Weinhold
(74) *Attorney, Agent, or Firm*—Dilworth & Barrese LLP

(57) ABSTRACT

The present invention is directed to an improved paper holder having minimal components and functioning by gravitational action to retain paper. Need for an elastic biasing member for biasing a holding member is eliminated.

16 Claims, 2 Drawing Sheets

PAPER HOLDER

BACKGROUND OF THE INVENTION

The present invention relates to an improved paper holder for holding paper or the like and which can securely, stably retain paper and, at the same time, minimize danger of an individual's fingers being caught in moving components during use.

More particularly, the present invention is directed to a paper holder minimizing the number of moving components required, notably eliminating need for a spring or similar biasing means.

A variety of paper holders have been developed for retaining sheets of paper that can be easily seen while operating, e.g., a word processor, typewriter, personal computer, etc. For example, U.S. Pat. No. 5,667,183 to Hiromori discloses a paper holder having complementary convex and concave surfaces to retain paper in an upright and somewhat curved state. U.S. Pat. No. 5,845,889 to Suzuki discloses a paper clip in which two clamping members are pivotally coupled together and biased into abutment by a spring, with one of the clamping members being additionally pivotally mounted upon a fixed base plate.

Paper holders generally have a large number of exposed moving parts, resulting in the danger of unavoidably catching one's fingers during use. Accordingly, a goal has been eliminating the disadvantages and dangers encountered with prior art paper holders. Thus, U.S. patent application Ser. No. 09/566,744, filed May 9, 2000 is directed to a paper holder comprising a minimal number of exposed, protruding moving parts. In particular, the spring biasing the component parts together to retain paper therebetween is shielded from one's fingers.

Eliminating need for a biasing spring altogether would even further improve safety in handling a paper holder and simplify manufacture and use of the same.

Accordingly, it is an object of the present invention to provide a paper holder which minimizes or eliminates danger of catching one's fingers in moving components thereof.

It is also an object of the present invention to improve retention and clamping of paper in an upright position to be viewed, e.g., adjacent a computer, word processor, etc.

It is further object of the present inventor to facilitate manufacture of a paper holder with minimal number of moving components.

It is moreover another object of the present invention to eliminate need for a separate biasing element in a paper holder which can function to retain paper in an upright manner solely by the action of gravity.

SUMMARY OF THE INVENTION

These and other objects are attained by the present invention which is directed to a paper holder comprising two holding members, a first holding member provided with a convex holding surface and a second holding member provided with a substantially complementary concave holding surface. A spindle is provided along one bottom edge of one of the holding members and upon which the other holding member is pivotally mounted, such that the holding members can be pivoted to open and receive paper therebetween, e.g., by hand. Upon placement of the holding members, e.g., upon a desk, table, etc., gravity automatically creates opposite moments acting upon the holding members to thus bias the holding surfaces of the first and second holding members together under pressure, whereby paper situated between the holding surfaces is retained in an erect and somewhat curved state, without need for a separate spring component to bias the holding surfaces together.

The bottom surfaces of both holding members are shaped such that the spindle and coupling are substantially located at an apex of an arc when the paper holder is placed upon a horizontal flat surface; only edges of the holding members opposite the spindle coupling contact the surface to thereby generate opposite arcuate moments upon the holding members to retain paper situated therebetween. The bottom surfaces of the holding members can be open such that only the edges of the holding members furthest from the spindle coupling contact the surface when placed thereon.

Thus, a compact paper holder is provided with a minimal number of moving components. Therefore, the danger of accidentally catching one's fingers in moving parts of the paper holder during use is greatly minimized if not totally eliminated. Furthermore, reliability and ease in clamping and retention of paper in an upright, easily-viewed position is improved with the inventive paper holder. Manufacture of such a paper holder is greatly facilitated by reduction of individual separate components that must be coupled together. In particular, gravity is employed to generate coupling action without need for separate force such as a biasing spring. The inventive paper holder can be manufactured entirely from (clear) plastic, thus improving ease of manufacture and helping conserve raw materials.

BRIEF DESCRIPTION OF THE DRAWINGS

The present invention will be explained in greater detail by way of the accompanying drawings, in which.

DESCRIPTION OF THE PREFERRED EMBODIMENTS

Figure 1:
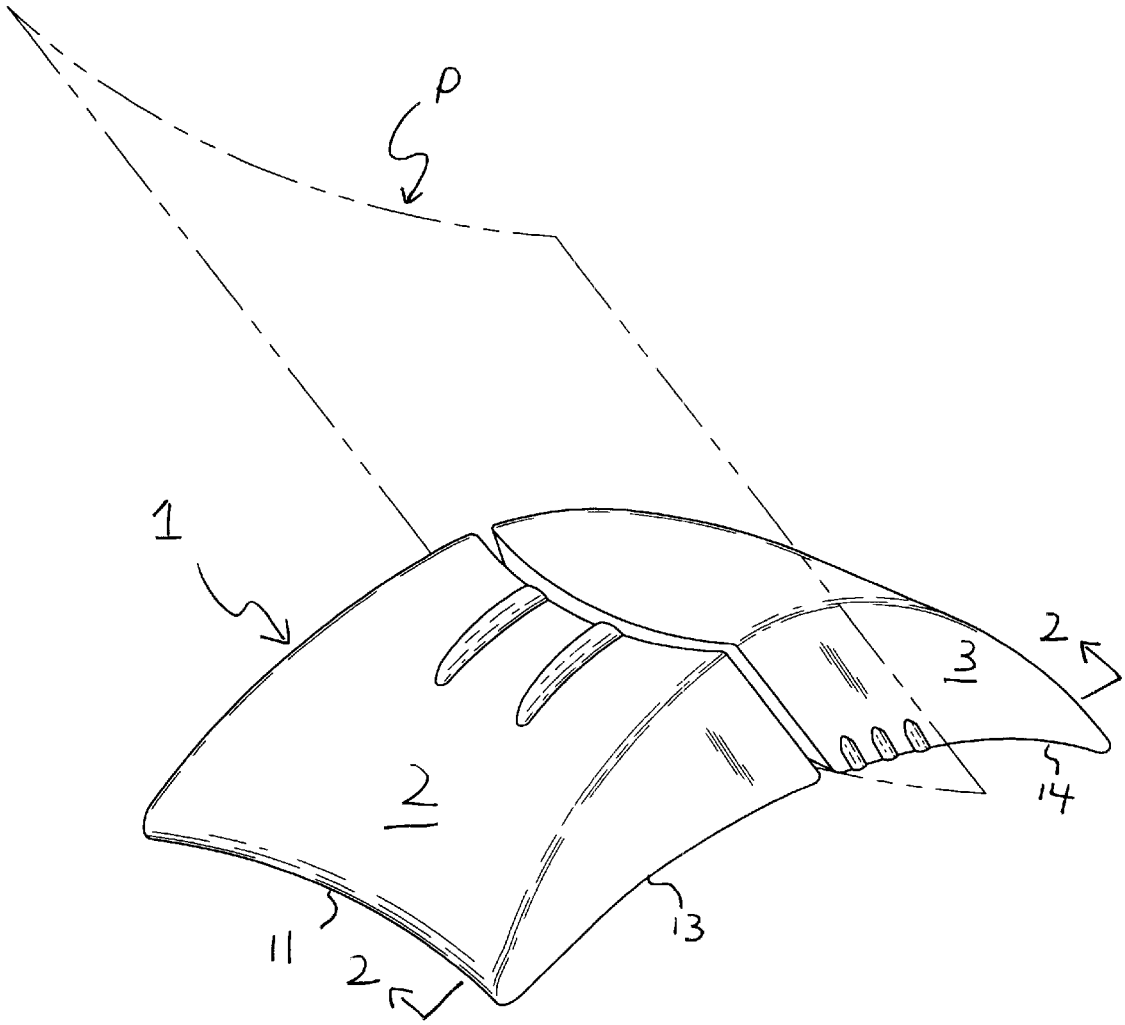
FIG. 1 is a perspective view of the paper holder in accordance with the present invention and schematically illustrating retention of a paper therein, in phantom.

Referring to the drawings, in which the same or similar elements are denoted by the same reference numerals or reference numerals with prime (') superscripts, the paper holder 1 of the present invention comprises two holding member 2, 3 pivotally coupled together. Holding members 2, 3 respectively have concave 9 and convex 10 surfaces which are substantially complementary to one another. Alternatively, the concave surface can be provided on the movable holding member 3 and the convex holding surface on the holding member 2 within the context of the present invention.

The holding member 2 is pivotally mounted upon the holding member 3 through a spindle 5 provided along a bottom edge of the holding member 3 facing the holding member 2. Holding member 2 comprises two internal ribs, one of which 16 is seen in the sectional views of FIGS. 2 and 3, and comprising lower extensions 7, 7' underneath a bottom edge 15 of holding member 2 facing holding member 3; each extension 7, 7' contains a hole 6, 6' positioned to mate with projections 4 (one of which is seen in the figures, the other on the opposite side of the spindle 5 being hidden from view) situated upon opposite ends of the spindle 5 and couple the holding members 2, 3 together to form a fulcrum about the spindle 6, with minimal number of coupling components (please see arrows C, C' illustrating the coupling in FIG. 4). There may optionally be several interior ribs (e.g. five) within holding member 2 to provide increased strength and support.

Figure 2:
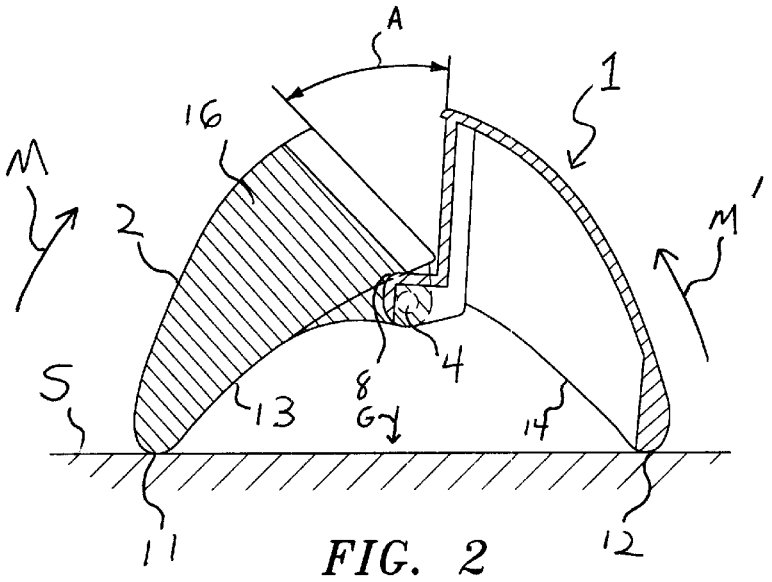
FIG. 2 is a sectional view in the along line 2—2 in FIG. 1 and illustrating the paper holder in open position.

As shown in FIG. 2, the members 2, 3 can be rotated, e.g., with fingers, and/or by merely lifting off a table in a direction away from one another. Paper P can be inserted between surfaces 9 and 10 in the opened position shown in FIG. 2. Then, the movable members 2,3 are placed upon a lower surface, e.g., a desk or table, and slowly released from the position illustrated in FIG. 2 to the position illustrated in FIG. 3, so that by the action of gravity, holding members 2 and 3 return to the initial position shown in FIGS. 1 and 3 and paper P is retained between the holding members as shown in FIG. 1 (please see the double headed arrow A in FIG. 2 which denotes pivoting directions of members 2 and 3 with respect to each other).

The components forming the members 2, 3 can be molded from hard plastic or similar synthetic resin and with each component optionally molded from clear or transparent plastic. In the illustrated embodiment, the holding members 2 and 3 are separately molded as two sections and then joined together by snapping openings 6, 6' about protrusions 4 (see arrows C, C' in FIG. 4). Spindle 5 can be integrally molded as part of holding member 3.

Figure 3:
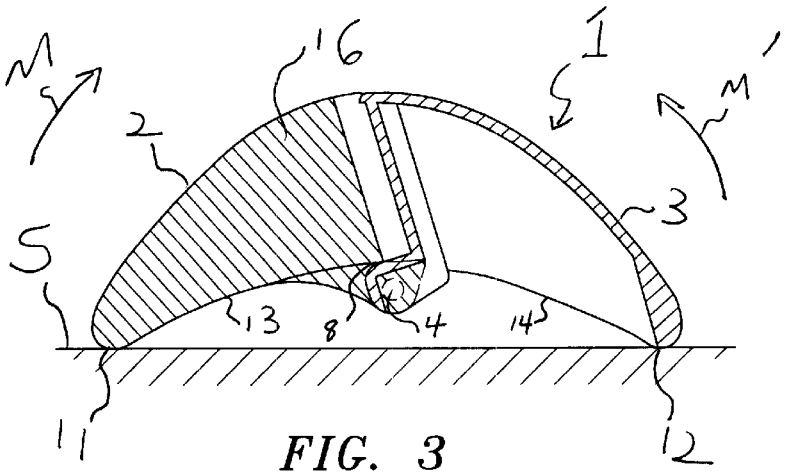
FIG. 3 is a sectional view along line 2—2 FIG. 1 and illustrating the paper holder in closed position.

The bottom surfaces of holding members 2 and 3 are open or hollow, with respective bottom edges 13, 14 of holding members 2 and 3 being curved in a direction substantially perpendicular to the spindle 5 direction such that the spindle 5 is, at all times, located at an apex of an arc as shown in FIGS. 2 and 3. Particularly, when the paper holder 1 is placed upon a flat surface S as shown in FIGS. 2 and 3, only bottom edges 11 and 12 of respective holding members 2 and 3 which are located at an opposite end from the fulcrum 6 and which extend substantially parallel to the fulcrum 6, contact the flat surface S. Thus, when the components 2, 3 are released from the position shown in FIG. 2, the force of gravity will naturally cause the paper holder 1 to move to the lowest center of gravity (see arrow G in FIG. 2) with opposite moments M, M' being generated upon holding members 2 and 3 as shown. Paper P will thus be securely retained between the holding members 2 and 3 by just force of gravity alone and without need for further biasing means such as a spring to hold components 2 and 3 together. Bottom edges 11 and 12 can be curved in a direction of the spindle 5 (see FIG. 1).

Figure 4:
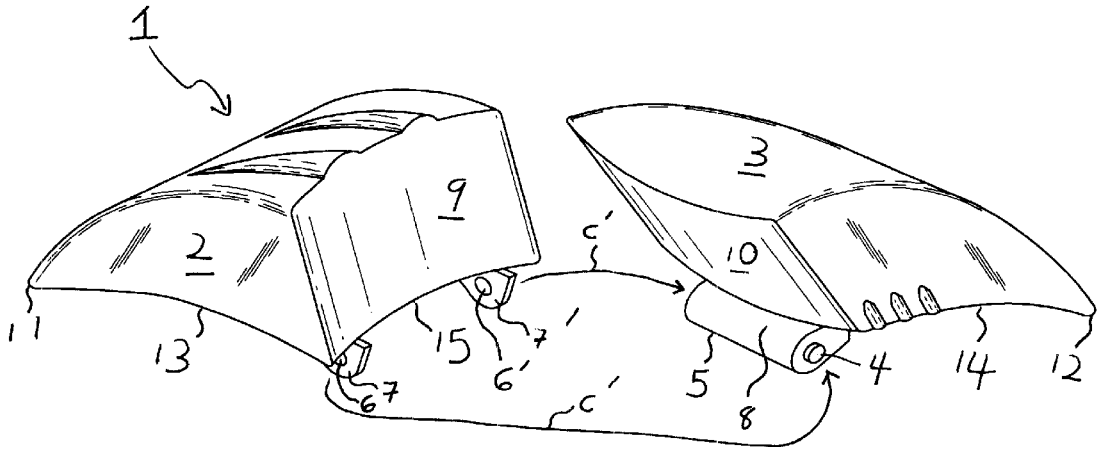
FIG. 4 is an exploded view illustrating the individual paper holder components of the present invention.

Moreover, the spindle 5 comprises a forward edge 8 which is curved in the embodiment shown in FIG. 4. This forward edge 8 is positioned to ride against bottom edge 15 of holding member 2, in open position of approximately 30° as shown in FIG. 2, and thus provide friction against opening the holding members 2 and 3 beyond this particular point. This further facilitates stability in use of the inventive paper holder 1 and minimizes wear and tear upon the spindle 5 couplings 4, 6.

The preceding description of the present invention is merely exemplary and is not intended to limit the scope thereof in any way.

What is claimed:

1. A paper holder, comprising two holding members, a first holding member provided with a convex holding surface and a second holding member provided with a substantially complementary concave holding surface, a spindle about which said holding members are pivotally coupled to one another forming a fulcrum, and said holding members shaped such that opposite gravitational moments act upon said holding members to bring the same into secure retentive contact with one another, whereby paper placed between said holding members is securely retained therebetween by the action of gravity.

2. The paper holder of claim 1, wherein the paper is retained between said holding members solely by the action of gravity on the holding members.

3. The paper holder of claim 1, wherein said holding members are structured and arranged to securely retain the paper therebetween in the absence of spring members or other biasing elements in said holding members.

4. The paper holder of claim 1, wherein said holding members are shaped such that only bottom edges opposite said fulcrum contact a surface when said holder is placed thereon, thereby generating said closing gravitational moments.

5. The paper holder of claim 4, wherein said bottom edges extend substantially parallel to said spindle.

6. The paper holder of claim 4, wherein said holding members are structured and arranged such that when said holder is placed upon the surface, said fulcrum is located at an apex of an arc defined by said opposite bottom edges of said holding member when viewed in a direction of said spindle, to thereby generate said opposite gravitational moments.

7. The paper holder of claim 1, wherein said spindle is mounted upon one of said holding members and said other holding member comprises means for coupling the same to said spindle.

8. The paper holder of claim 7, wherein said coupling means comprise at least one aperture positioned to mate with said spindle, whereby said holding members are pivotally coupled together.

9. The paper holder of claim 8, wherein the said coupling means comprise a pair of apertures positioned to mate with said spindle at opposite ends thereof.

10. The paper holder of claim 8, wherein said spindle is mounted upon a bottom edge of said one holding member facing said other holding member, and said at least one aperture is mounted upon a bottom edge of said other holding member.

11. The paper holder of claim 7, wherein said holding members are fabricated from hard plastic and said spindle and mounting holding member are integrally molded.

12. The paper holder of claim 7, wherein said spindle comprises a forward edge arranged to contact a lower facing edge of said other holding member when said holding members are pivoted open away from one another to receive paper, whereby said holding members are prevented from automatically pivoting open away from one another beyond a certain point.

13. The paper holder of claim 4, wherein said bottom opposite edges of said holding members are curved in a direction of said spindle.

14. The paper holder of claim 6, wherein bottom edges of said holding members adjacent ends of said spindle are curved in a perpendicular direction to said spindle when coupled.

15. The paper holder of claim 6, wherein bottom surfaces of said holding members, when coupled, are open.

16. The paper holder of claim 9, additionally comprising a pair of internal ribs positioned within said other holding member and each comprising a lower protrusion from underneath a bottom edge of said other holding member and through which a respective one of said apertures extends.

* * * * *